US008059073B2

(12) United States Patent
Shin et al.

(10) Patent No.: US 8,059,073 B2
(45) **Date of Patent: *Nov. 15, 2011**

(54) ORGANIC LIGHT EMITTING DIODE DISPLAY AND DRIVING METHOD THEREOF

(75) Inventors: Hye-jin Shin, Suwon-si (KR); Myung-ho Lee, Suwon-si (KR)

(73) Assignee: Samsung Mobile Display Co., Ltd., Suwon-Si, Gyeonggi-Do (KR)

( * ) Notice: Subject to any disclaimer, the term of this patent is extended or adjusted under 35 U.S.C. 154(b) by 960 days.

This patent is subject to a terminal disclaimer.

(21) Appl. No.: 12/007,452

(22) Filed: Jan. 10, 2008

(65) Prior Publication Data

US 2008/0204380 A1 Aug. 28, 2008

(30) Foreign Application Priority Data

Feb. 23, 2007 (KR) ..... 10-2007-0018695

(51) Int. Cl.
*G09G 3/32* (2006.01)

(52) U.S. Cl. ..... 345/83

(58) Field of Classification Search ..... 345/76–89, 345/690, 694, 695; 315/169.1–169.3
See application file for complete search history.

(56) References Cited

U.S. PATENT DOCUMENTS

| | | | | |
|---|---|---|---|---|
| 5,315,694 | A * | 5/1994 | Kasano | 345/591 |
| 6,823,083 | B1 * | 11/2004 | Watanabe et al. | 382/167 |
| 2001/0050757 | A1 | 12/2001 | Yoshida et al. | |
| 2003/0231160 | A1 | 12/2003 | Yoshihara et al. | |
| 2004/0196303 | A1 * | 10/2004 | Matsuda | 345/690 |
| 2004/0222999 | A1 * | 11/2004 | Choi et al. | 345/589 |
| 2005/0073516 | A1 * | 4/2005 | Kang | 345/204 |
| 2005/0087671 | A1 | 4/2005 | Park | |
| 2006/0244697 | A1 | 11/2006 | Lee et al. | |
| 2007/0040774 | A1 * | 2/2007 | Lee et al. | 345/77 |
| 2007/0165048 | A1 | 7/2007 | Yamashita et al. | |
| 2007/0188623 | A1 | 8/2007 | Yamashita et al. | |

FOREIGN PATENT DOCUMENTS

| | | |
|---|---|---|
| CN | 1855202 | 11/2006 |
| JP | 2003-228330 A | 8/2003 |
| JP | 2004-325565 A | 11/2004 |
| JP | 2005-253050 A | 9/2005 |

(Continued)

OTHER PUBLICATIONS

Chinese Office Action in CN 2008100805857, dated Dec. 15, 2010 (Shin, et al.) Chinese Office Action from prosecution of corresponding Chinese application. Japanese Office Action in JP 2007-116014, dated Sep. 28, 2010 (Shin, et al.) Japanese Office Action from prosecution of corresponding Japanese application.

*Primary Examiner* — Chanh Nguyen
*Assistant Examiner* — Pegeman Karimi
(74) *Attorney, Agent, or Firm* — Lee & Morse, P.C.

(57) ABSTRACT

An organic light emitting diode (OLED) display, including a pixel portion having a plurality of pixels connected to scan lines and data lines, a scan driver adapted to generate and supply scan signals to the scan lines, a data driver adapted to generate and supply data signals to the data lines, an optical sensor adapted to generate an optical sensing signal according to an intensity of light, and a data converter adapted to store input image data or changed data from the input image data corresponding with the optical sensing signal. The data driver may be adapted to generate the data signal corresponding to the input image data or the changed data.

15 Claims, 4 Drawing Sheets

FOREIGN PATENT DOCUMENTS

| | | | |
|---|---|---|---|
| JP | 2006-243454 | A | 9/2006 |
| JP | 2006-267140 | A | 10/2006 |
| JP | 2006-337997 | A | 12/2006 |
| JP | 2006-350316 | A | 12/2006 |
| KR | 10-1990-0003762 | A | 3/1990 |
| KR | 10-54440 | B1 | 9/1992 |
| KR | 10-2005-0011297 | | 1/2005 |
| KR | 10-2006-0113009 | A | 11/2006 |
| KR | 10-2006-0120643 | A | 11/2006 |
| WO | WO 2006-088118 | A1 | 8/2006 |

* cited by examiner

FIG. 3A $$A\begin{bmatrix} R_{in} \\ G_{in} \\ B_{in} \end{bmatrix} = \begin{bmatrix} R_s \\ G_s \\ B_s \end{bmatrix}$$

FIG. 3B $$A = \begin{bmatrix} 0.299+0.701\times k & 0.587\times(1-k) & 0.114\times(1-k) \\ 0.299\times(1-k) & 0.587+0.413\times k & 0.114\times(1-k) \\ 0.299\times(1-k) & 0.587\times(1-k) & 0.114+0.886\times k \end{bmatrix}$$

FIG. 3C $$\begin{bmatrix} 0.299+0.701\times k & 0.587\times(1-k) & 0.114\times(1-k) \\ 0.299\times(1-k) & 0.587+0.413\times k & 0.114\times(1-k) \\ 0.299\times(1-k) & 0.587\times(1-k) & 0.114+0.886\times k \end{bmatrix}\begin{bmatrix} R_{in} \\ G_{in} \\ B_{in} \end{bmatrix} = \begin{bmatrix} R_s \\ G_s \\ B_s \end{bmatrix}$$

FIG. 3D $$\begin{bmatrix} 0.299 & 0.587 & 0.114 \\ 0.299 & 0.587 & 0.114 \\ 0.299 & 0.587 & 0.114 \end{bmatrix}\begin{bmatrix} R_{in} \\ G_{in} \\ B_{in} \end{bmatrix} = \begin{bmatrix} R_s \\ G_s \\ B_s \end{bmatrix}$$

ORGANIC LIGHT EMITTING DIODE DISPLAY AND DRIVING METHOD THEREOF

BACKGROUND OF THE INVENTION

1. Field of the Invention

Example embodiments relate to an organic light emitting diode (OLED) display and a driving method thereof. More particularly, example embodiments relate to an OLED display having improved display and visibility across varying ambient light conditions and driving methods thereof.

2. Description of the Related Art

Recently, various flat display technologies, i.e., plasma display panels (PDPs), liquid crystal displays (LCDs), and OLED displays, have been developed, which may have advantages over cathode ray tubes (CRT), e.g., reduced weight and volume. However, OLED displays may provide better luminance feature and color purity, as OLED displays use an organic compound as an emitting material. Further, OLED displays may be thin and light, and may be driven with low power and, thus, applicable to portable display devices.

However, because portable display devices may be exposed to varying environments and light conditions, e.g., exposed to outdoor visible light, display quality and viewability or visibility of an image displayed on the portable display device may be reduced. In other words, the brightness of an image displayed on the portable display device may be reduced (or faded out) under light, e.g., solar light, in which surrounding or ambient light illumination intensity may be brighter than the brightness of the image displayed.

Therefore, there is a need for the development of a portable display device, e.g., an OLED display, having improved display and viewability across varying ambient light conditions and methods of driving such devices.

SUMMARY OF THE INVENTION

Example embodiments are therefore related to an OLED display, and methods for driving the same, which substantially overcome one or more of the problems due to the limitations and disadvantages of the related art.

It is therefore a feature of example embodiments to provide an OLED display having improved display and viewability across varying ambient light conditions, e.g., across varying intensities of peripheral light.

At least one of the above and other features of example embodiments may provide an OLED display, including a pixel portion having a plurality of pixels connected to scan lines and data lines, a scan driver adapted to generate and supply scan signals to the scan lines, a data driver adapted to generate and supply data signals to the data lines, an optical sensor adapted to generate an optical sensing signal according to an intensity of light, and a data converter adapted to store input image data or changed data from the input image data corresponding to the optical sensing signal. The data driver may be adapted to generate the data signal corresponding to the input image data or the changed data.

The data converter may further include a comparator adapted to output a selection signal corresponding to the optical sensing signal, a controller adapted to determine a change or a non-change of the input image data corresponding to the selection signal, a first calculator adapted to generate pixel saturation data corresponding to the input image data received from the controller, a second calculator adapted to extract changed data corresponding to the pixel saturation data, and a memory adapted to store the input image data received from the controller or the changed data supplied from the second calculator.

The comparator may compare the optical sensing signal with a predetermined reference value. The comparator may output the selection signal not to change the input image data when the optical sensing signal is less than the predetermined reference value.

The controller may store the input image data in the memory corresponding to the selection signal.

The comparator may output the selection signal to change the input image data when the optical sensing signal is greater than the predetermined reference value. The controller may transmit the input image data to the first calculator corresponding to the selection signal.

The OLED display may further include a saturation change matrix to be calculated by the first calculator.

The first calculator may calculate input data by subpixels included in the input image data and the saturation change matrix to obtain destination saturation data by subpixels, and may generate the pixel saturation data using the destination saturation data.

The OLED display may further include a reference look-up table calculated by the second calculator. The reference look-up table may include saturation and luminance look-up tables.

The second calculator may extract the change data from the reference look-up table corresponding to the pixel saturation data.

The second calculator linearly may interpolate between two values adjacent to the pixel saturation data among values stored in the reference look-up table, so as to extract the changed data when the pixel saturation data not stored in the reference look-up table are input.

At least one of the above and other features of example embodiments may provide a method for driving an OLED display. The method may include supplying scan signals generated by a scan driver to scan lines, supplying data signals generated by a data driver to data lines, generating an optical sensing signal according to an intensity of light sensed on an optical sensor, and storing input image data or changed input image data in accordance with the optical sensing signal. The data driver generates the data signal corresponding to the input image data or the changed input image data.

The method may further include generating a selection signal corresponding to the intensity of light, determining a state of input image data according to the selection signal, and extracting data when the changed input image data is determined, the changed data being obtained by changing at least one of a saturation or a luminance of the input image data.

The selection signal may be set to change the input image data when the intensity of light is greater than a predetermined reference value.

The method of extracting changed data when the change of the input image data is determined may further include generating pixel saturation data from the input image data, and extracting changed data from a reference look-up table corresponding to the pixel saturation data.

The method of generating pixel saturation data from the input image data further includes calculating the input image data and a saturation change matrix to obtain destination saturation data by subpixels, and generating the pixel saturation data corresponding to the destination saturation data by subpixels.

The method may further include performing a linear interpolation between two values adjacent to the pixel saturation data among the values stored in the reference look-up table to extract the changed data when the pixel saturation data not stored in the reference look-up table are input.

The selection signal may be set not to change the input image data when an intensity of light is less than a predetermined reference value.

The method may further include storing the input image data and generating a data signal corresponding to the stored input image data.

BRIEF DESCRIPTION OF THE DRAWINGS

The above and other features and advantages of example embodiments will become more apparent to those of ordinary skill in the art by describing in detail example embodiments thereof with reference to the attached drawings, in which:

FIG. 3A to FIG. 3D illustrate matrices of exemplary calculating destination saturation data by subpixels using a saturation change matrix by a first calculator shown in FIG. 2.

DETAILED DESCRIPTION OF THE INVENTION

Korean Patent Application No. 10-2007-0018695, filed on Feb. 23, 2007, in the Korean Intellectual Property Office, and entitled: "Organic Light Emitting Display and Driving Method Thereof," is incorporated by reference herein in its entirety.

Example embodiments will now be described more fully hereinafter with reference to the accompanying drawings; however, the example embodiments may be embodied in different forms and should not be construed as limited to the embodiments set forth herein. Rather, these example embodiments are provided so that this disclosure will be thorough and complete, and will fully convey the scope of the invention to those skilled in the art.

Figure 1:
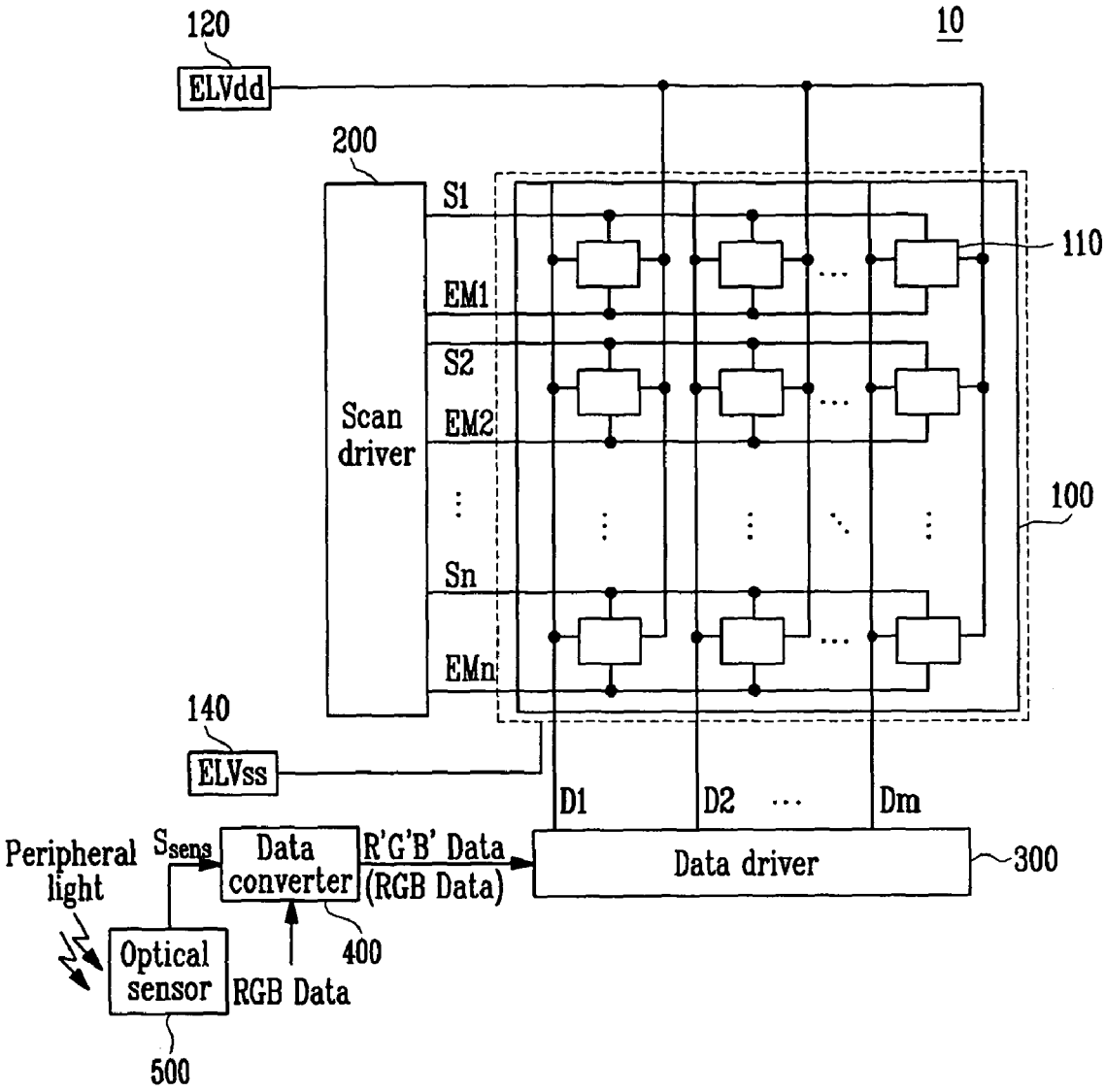
FIG. 1 illustrates a schematic view of an OLED display according to an example embodiment.

FIG. 1 illustrates a schematic view of an OLED display 10 according to an example embodiment.

Referring to FIG. 1, the OLED display 10 may include a pixel portion 100, a scan driver 200, a data driver 300, a data converter 400, and an optical sensor 500. It should be appreciated that other devices and/or elements may be included or excluded in the OLED display 10.

The pixel portion 100 may include a plurality of pixels 110, which may be connected to emission control lines EM1 to EMn and data lines D1 to Dm. In an example embodiment, one pixel 110 may include an OLED, and may be composed of at least two subpixels for emitting light of different colors, e.g., red, green and blue. It should be appreciated that other configuration of the subpixels may be employed.

The pixel portion 100 may display images corresponding to a voltage of a first power supply ELVdd 120, and a voltage of a second power supply ELVss 140. The pixel portion 100 may further display images corresponding to a scan signal supplied by the scan lines S1, S2, . . . , Sn and an emission control signal supplied by the emission control lines EM1, EM2, . . . , EMn generated from the scan driver 200, and a data signal supplied by the data lines D1, D2, . . . , Dm generated from the data driver 300.

The scan signals generated by the scan driver 200 may be sequentially supplied to respective scan lines S1 to Sn, and the emission control signals also generated by the scan driver 200 may be sequentially supplied to respective emission control lines EM1 to EMn. It should be appreciated that the scan signals and the emission control signals may also be non-sequentially supplied to the scan lines S1 to Sn and the emission control lines EM1 to EMn, respectively.

The data driver 300 may receive image data R'G'B' Data (or RGB Data) from the data converter 400 and may generate data signals corresponding thereto. The data signals generated by the data driver 300 may be supplied to the data lines D1 to Dm in synchronization with the scan signal and may be transferred to each pixel 110. It should be appreciated that the data signals may also be supplied to the data lines D1 to Dm in a non-synchronization manner with the scan signal.

The data converter 400 may select one of the states (e.g., a changed or a non-changed state) of the input image data RGB Data according to an optical sensing signal $S_{sens}$ input from an optical sensor 500. Further, the data converter 400 may store changed data R'G'B' Data, which may be obtained by changing input image data RGB Data or input image data RGB Data.

Further, the data converter 400 may generate and store changed data R'G'B' Data when a change of the input image data RGB Data is necessary. In particular, the changed data R'G'B' Data may be obtained by changing a luminance value and/or saturation value of the input image data RGB Data.

Further, when a changed input image data RGB Data is not required, the data converter 400 may store the input image data RGB Data supplied thereto.

The changed data R'G'B' Data and/or the input image data RGB Data stored in the data converter 400 may be input to the data driver 300.

The optical sensor 500 may include an optical sensing device, i.e., a transistor or a photo diode, and may sense an intensity of peripheral or ambient light. The optical sensor 500 may then generate an optical sensing signal $S_{sens}$ corresponding to the sensed intensity of the peripheral or ambient light. The optical sensing signal $S_{sens}$ generated by the optical sensor 500 may then be supplied to the data converter 400.

Further, the data converter 400 may generate the changed data R'G'B' Data so as to enhance the visibility when the optical sensing signal $S_{sens}$ is greater than a predetermined reference value. Further, the changed data R'G'B' Data may be obtained by changing the input image data RGB Data. For example, when the optical sensing signal $S_{sens}$ corresponding to light intensity greater than the predetermined reference value is supplied, the data converter 400 may generate the changed data R'G'B' Data to control an improvement of the visibility. In implementation, the changed data R'G'B' Data may be obtained by increasing a saturation of the input image data RGB Data.

Further, the input image data RGB Data may be changed according to ambient environment conditions, e.g., an intensity of peripheral or ambient light, in order to improve the visibility of an image displayed in the pixel portion 100.

Figure 2:
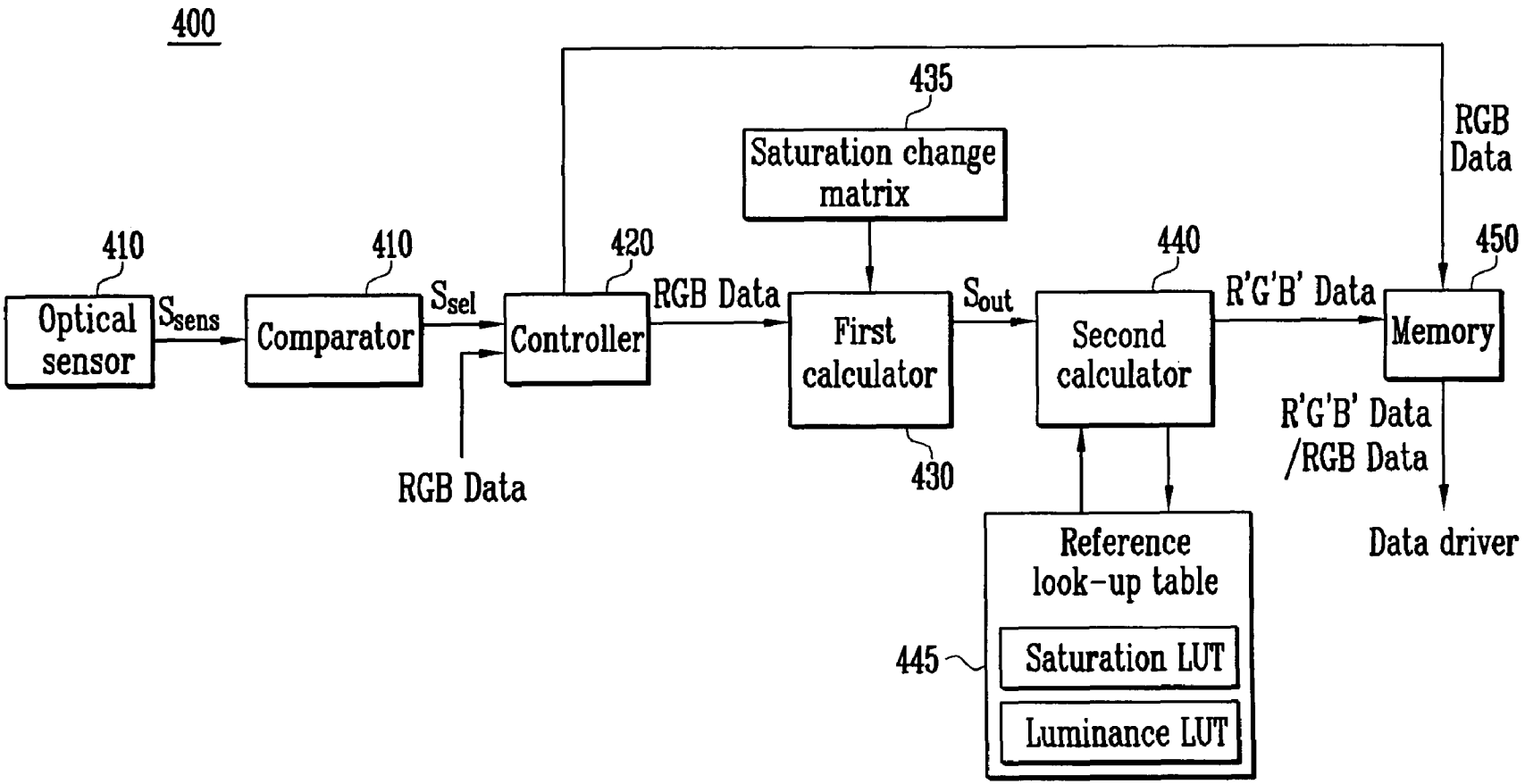
FIG. 2 illustrates a schematic view of an exemplary data converter shown in FIG. 1.

Referring to FIG. 2, the data converter 400 may include a comparator 410, a controller 420, a first calculator 430, a saturation change matrix 435, a second calculator 440, a reference look-up table 445, and a memory 450. It should be appreciated that other components and/or devices may be included or excluded in the data converter 400.

The comparator 410 may compare an optical sensing signal $S_{sens}$ supplied from the optical sensor 500 with a predetermined reference value and may output a corresponding selection signal $S_{sel}$.

For example, when the optical sensing signal $S_{sens}$ is less than the predetermined reference value, the comparator 410 may output a selection signal $S_{sel}$ so that the input image data RGB Data is not changed. Alternatively, when the optical sensing signal $S_{sens}$ is equal to or greater than the predetermined reference value, the comparator 410 may output a selection signal $S_{sel}$ to change the input image data RGB Data.

The selection signal $S_{sel}$ output from the comparator 410 may then be provided to the controller 420. The controller 420 may determine a state (e.g., changed or a non-changed) of the input image data RGB Data corresponding to the input selection signal $S_{sel}$.

The controller 420 may further transfer and/or store the input image data RGB Data to the first calculator 430 or, alternatively, to the memory 450 according to the determined changed or non-changed input image data RGB Data.

Further, when the changed input image data RGB Data is selected, the controller 420 may transfer the input image data RGB Data to the first calculator 430. Further, when the non-changed input image data RGB Data is selected, the controller 420 may store the input image data RGB Data in the memory 450.

The first calculator 430 may generate pixel saturation data $S_{out}$ corresponding to the input image data RGB Data from the controller 420 while referencing the saturation change matrix 435.

Further, the first calculator 430 may calculate input data Rin, Gin, and Bin by subpixels along with the saturation change matrix 435 so as to obtain destination saturation data Rs, Gs, and Bs by subpixels, and may generate the pixel saturation data $S_{out}$ using the same.

Further, the destination saturation data Rs, Gs, and Bs by subpixels may be calculated using the saturation change matrix 435. A method for calculating the destination saturation data Rs, Gs, and Bs by subpixels will be explained later with reference to FIG. 3A to FIG. 3D.

The pixel saturation data $S_{out}$ may be calculated from the destination saturation data Rs, Gs, and Bs by subpixels. The pixel saturation data $S_{out}$ may be set to a maximum value among the destination saturation data Rs, Gs, and Bs by subpixels or, alternatively, to a predetermined value corresponding to a difference between a maximum value and a minimum value of the destination saturation data Rs, Gs, and Bs by subpixels.

The pixel saturation data $S_{out}$ generated by the first calculator 430 may be provided to the second calculator 440. The second calculator 440 may extract the changed data R'G'B' Data from the reference look-up table 445 corresponding to the pixel saturation data $S_{out}$ supplied from the first calculator 430, and may store the changed data R'G'B' Data in the memory 450.

In particular, the second calculator 440 may extract the changed data R'G'B' Data having desired saturation and luminance values by referencing a saturation look-up table (LUT) and a luminance look-up table (LUT) stored in the reference look-up table 445. The saturation LUT and the luminance LUT may include tables to extract a saturation change value and a luminance change value corresponding to the pixel saturation data $S_{out}$, respectively.

Further, when the pixel saturation data $S_{out}$, which may not be stored in the reference look-up table 445, are input, the second calculator 440 may extract the changed data R'G'B' Data by referencing two values adjacent to the pixel saturation data $S_{out}$ (e.g., values stored in the reference look-up table 445). The second calculator 440 may linearly interpolate the changed values, which may correspond to a maximum value among values less than input pixel saturation data $S_{out}$ and a minimum value among values greater than the pixel saturation data $S_{out}$, in order to extract the changed data R'G'B' Data.

The memory 450 may store the input image data RGB Data from the controller 420 or the changed data R'G'B' Data from the second calculator 440. The input image data RGB Data or the changed data R'G'B' Data may be stored in the memory 450.

Referring to FIG. 3A to FIG. 3D, the first calculator 430 may multiply the saturation change matrix A by input data Rin, Gin and Bin by subpixels, included in the input image data RGB Data, to obtain destination saturation data Rs, Gs and Bs by subpixels.

Referring to FIG. 3B, the saturation change matrix A may also be a matrix to adjust the saturation using a saturation factor k to determine a saturation adjustment. Further, the saturation change matrix A may be used to convert values of the input data Rin, Gin and Bin by subpixels by a previously selected saturation factor k so as to calculate the data Rs, Gs and Bs by subpixels.

The saturation change matrix A may be set in consideration of a white balance of a pixel, and/or the matrix (as shown in FIG. 3B) may be generally used as the saturation change matrix A.

When the saturation factor k is greater than 1, the saturation may be increased. Alternatively, when the saturation factor k is less than 1, the saturation may be reduced. When the saturation factor k is 1 (e.g., the saturation change matrix A is a unit matrix of 3×3), the saturation may remain the same, i.e., unchanged (as illustrated in FIG. 3C).

Further, when all destination saturation data Rs, Gs, and Bs by subpixels are set to be identical with a rate of a white balance, the saturation factor k is zero, as illustrated in FIG. 3B. When, the saturation factor k is zero, the saturation may be changed to a gray image having no saturation, as illustrated in FIG. 3D.

Figure 4:
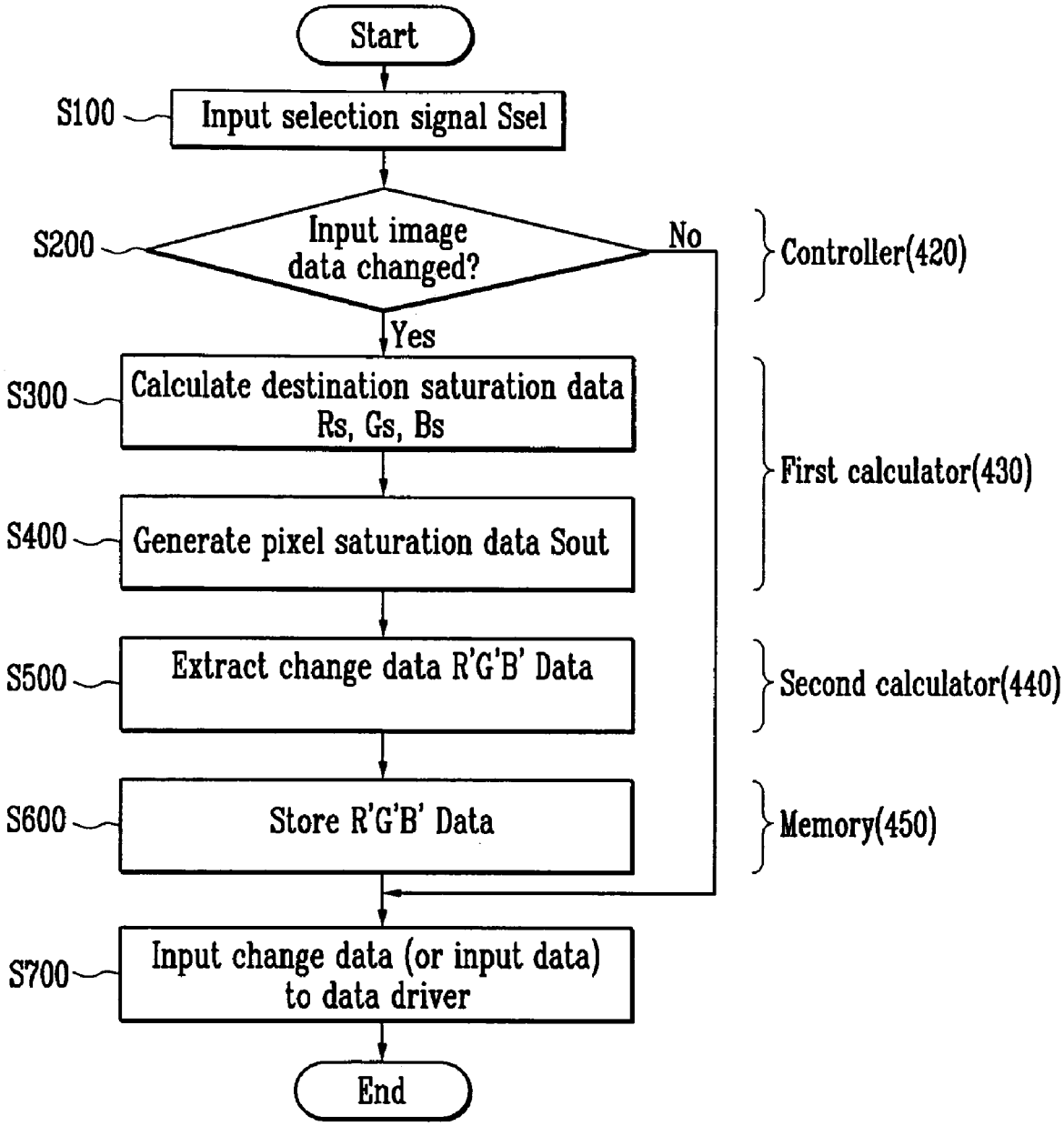
FIG. 4 illustrates a flow chart of a driving method of the data converter shown in FIG. 2.

FIG. 4 illustrates a flow chart of a driving method of the data converter 400 shown in FIG. 2.

Referring back to FIG. 2, when an optical sensing signal $S_{sens}$ corresponding to an intensity of peripheral light from the optical sensor 500 is input to the comparator 410, the comparator 410 may compare the optical sensing signal $S_{sens}$ with a predetermined reference value and may generate a corresponding selection signal $S_{sel}$.

The selection signal $S_{sel}$ may be a signal to control a state (e.g., change or a non-change) of data. For example, when the intensity of the peripheral light is less than the predetermined reference value, the selection signal is set to '0' indicating a 'not changed' state. Further, when the intensity of the peripheral light is equal to or greater than the predetermined reference value, the selection signal can become a signal of 1 bit set to '1' indicating a 'changed' state.

Referring to FIG. 4, in S100, the selection signal $S_{sel}$ generated by the comparator 410 may be input to the controller 420.

When the controller 420 receives the selection signal $S_{sel}$, the controller 420 may determine whether a change or a non-change input image data RGB Data corresponding to the selection signal $S_{sel}$ is determined (S200). Accordingly, when the selection signal $S_{sel}$ for controlling data not be changed is input to the controller 420, the controller 420 may not change the input image data RGB Data supplied thereto, and may supply the data to the data driver 300. The input image data RGB Data may be temporarily stored in the memory 450 and may be input to the data driver 300 under a control of the controller 420.

Alternatively, when the selection signal $S_{sel}$ calls for a change input image data RGB Data, the controller 420 may transfer the input image data RGB Data supplied thereto to the first calculator 430. The first calculator 430 may calculate the input image data RGB Data and the saturation change matrix 435 to obtain the destination saturation data Rs, Gs, and Bs by subpixels (S300), and may generate and provide a corresponding pixel saturation data $S_{out}$ to the second calculator 440 (S300).

The second calculator 440 may then extract changed data R'G'B' Data from the reference look-up table 445 corresponding to the pixel saturation data $S_{out}$ (S500) and may store the changed data R'G'B' Data in the memory 450 (S600).

The changed data R'G'B' Data may be the input image data RGB Data, in which the saturation and/or luminance of the input image data RGB Data may be changed, from the reference look-up table unit 445. Further, when the changed data R'G'B' Data corresponding to the pixel saturation data $S_{out}$ supplied from the first calculator 430 is not stored in the reference look-up table 445, the second calculator 440 may extract and store the changed data R'G'B' Data corresponding to the pixel saturation data $S_{out}$ by, for example, a linear interpolation in the memory 450.

The changed data R'G'B' Data stored in the memory 450 may be input to the data driver 300 (S700), so that the data may be used to generate a data signal.

Example embodiments relate to an OLED display and driving methods thereof providing an input image data that may be dynamically changed corresponding to an ambient environment, i.e., based on the intensity of peripheral light, in order to improve and enhance the quality, visibility and/or viewability of the display device. For example, when an OLED display is exposed to peripheral light greater than a predetermined reference value, changed data may be generated and a corresponding changed image may be displayed, so that the visibility and/or viewability of the display device may be improved under the changing ambient or peripheral light conditions, e.g., solar light. The changed data may be obtained by increasing a saturation of the input image data.

Although the terms "first" and "second" etc. may be used herein to describe various elements, structures, components, regions, layers and/or sections, these elements, structures, components, regions, layers and/or sections should not be limited by these terms. These terms are only used to distinguish one element, structure, component, region, layer and/or section from another element, structure, component, region, layer and/or section. Thus, a first element, structure, component, region, layer or section discussed below could be termed a second element, structure, component, region, layer or section without departing from the teachings of example embodiments.

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which example embodiments belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Example embodiments have been disclosed herein, and although specific terms are employed, they are used and are to be interpreted in a generic and descriptive sense only and not for purpose of limitation. Accordingly, it will be understood by those skilled in the art that various changes in form and details may be made without departing from the spirit and scope of the present invention as set forth in the following claims.

What is claimed is:

1. An organic light emitting diode OLED display, comprising:

a pixel unit including a plurality of pixels connected to scan lines and data lines;

a scan driver adapted to generate and supply scan signals to the scan lines;

a data driver adapted to generate and supply data signals to the data lines;

an optical sensor adapted to generate an optical sensing signal according to an intensity of light; and a data converter adapted to store input image data or changed input image data in accordance to the optical sensing signal, wherein the data converter includes:

a comparator adapted to output a selection signal corresponding to the optical sensing signal, a controller adapted to determine a state of the input image data corresponding to the selection signal, a first calculator adapted to generate pixel saturation data corresponding to the input image data received from the controller, a second calculator adapted to extract changed data corresponding to the pixel saturation data, and a memory adapted to store the input image data received from the controller or the changed data supplied from the second calculator, wherein the data driver is adapted to generate the data signal corresponding to the input image data or the changed input image data.

2. The OLED display as claimed in claim 1, wherein the comparator compares the optical sensing signal with a predetermined reference value.

3. The OLED display as claimed in claim 2, wherein the comparator outputs the selection signal not to change the input image data when the optical sensing signal is less than the predetermined reference value.

4. The OLED display as claimed in claim 3, wherein the controller stores the input image data in the memory corresponding to the selection signal.

5. The OLED display as claimed in claim 2, wherein the comparator outputs the selection signal to change the input image data when the optical sensing signal is greater than the predetermined reference value.

6. The OLED display as claimed in claim 5, wherein the controller transmits the input image data to the first calculator corresponding to the selection signal.

7. The OLED display as claimed in claim 1, further comprising a saturation change matrix to be calculated by the first calculator.

8. The OLED display as claimed in claim 7, wherein the first calculator calculates input data by subpixels included in the input image data and the saturation change matrix to obtain destination saturation data by subpixels, and generates the pixel saturation data using the destination saturation data.

9. The OLED display as claimed in claim 1, further comprising a reference look-up table calculated by the second calculator, the reference look-up table includes saturation and luminance look-up tables.

10. The OLED display as claimed in claim 9, wherein the second calculator extracts the change data from the reference look-up table corresponding to the pixel saturation data.

11. The OLED display as claimed in claim 10, wherein the second calculator linearly interpolates between two values adjacent to the pixel saturation data among values stored in the reference look-up table, so as to extract the changed data when the pixel saturation data not stored in the reference look-up table are inputted.

12. A method for driving an organic light emitting diode OLED display, comprising:

supplying scan signals generated by a scan driver to scan lines;

supplying data signals generated by a data driver to data lines;

generating an optical sensing signal according to an intensity of light sensed on an optical sensor; and storing input image data or changed input image data in accordance with the optical sensing signal, generating a selection signal corresponding to the intensity of light, wherein the selection signal is set to change the input image data when the intensity of light is greater than a predetermined reference value, determining a state of input image data according to the selection signal, extracting data when the changed input image data is determined, the changed input image data being obtained by changing at least one of a saturation or a luminance of the input image data, wherein extracting data when the changed input image data is determined further includes generating pixel saturation data from the input image data and extracting changed data from a reference look-up table corresponding to the pixel saturation data, performing a linear interpolation between two values adjacent to the pixel saturation data among the values stored in the reference look-up table to extract the changed data when the pixel saturation data not stored in the reference look-up table are input, wherein the data driver generates the data signal corresponding to the input image data or the changed input image data.

13. The method as claimed in claim 12, wherein generating pixel saturation data from the input image data further comprises:

calculating the input image data and a saturation change matrix to obtain destination saturation data by subpixels; and generating the pixel saturation data corresponding to the destination saturation data by subpixels.

14. The method as claimed in claim 12, wherein the selection signal is set not to change the input image data when an intensity of peripheral light is less than a predetermined reference value.

15. The method as claimed in claim 14, further comprising storing the input image data and generating a data signal corresponding to the stored input image data.

* * * * *